US006827121B2

(12) United States Patent
Park

(10) Patent No.: US 6,827,121 B2
(45) Date of Patent: Dec. 7, 2004

(54) ASSEMBLY POWER CURTAIN

(75) Inventor: Won-Seo Park, Seoul (KR)

(73) Assignee: Technogate Co., Ltd. (KR)

( * ) Notice: Subject to any disclaimer, the term of this patent is extended or adjusted under 35 U.S.C. 154(b) by 0 days.

(21) Appl. No.: 10/602,502

(22) Filed: Jun. 24, 2003

(65) Prior Publication Data

US 2004/0026049 A1 Feb. 12, 2004

Related U.S. Application Data

(63) Continuation of application No. PCT/KR01/02288, filed on Dec. 28, 2001.

(51) Int. Cl.[7] ..... A47H 1/00
(52) U.S. Cl. ..... 160/331
(58) Field of Search ..... 160/331, 345, 160/188, 189, 84.02, 168.1 P, 1, 7

(56) References Cited

U.S. PATENT DOCUMENTS 3,297,078 A * 1/1967 Seizo ..... 160/331
3,502,132 A * 3/1970 Hager et al. ..... 160/331
3,620,284 A * 11/1971 Shayman et al. ..... 160/11
3,672,425 A * 6/1972 Schulze-Robbecke et al. ... 160/331
4,437,506 A * 3/1984 Ogita ..... 160/331
4,492,262 A * 1/1985 Comeau ..... 160/126
4,724,860 A * 2/1988 Kelch ..... 137/196
4,827,199 A * 5/1989 Kaucic et al. ..... 318/491
5,371,447 A * 12/1994 Boss ..... 318/265
6,085,826 A * 7/2000 Maesaki ..... 160/345

FOREIGN PATENT DOCUMENTS

| | | |
|---|---|---|
| JP | 3-155809 | 7/1991 |
| JP | 2000-116503 | 4/2000 |
| KR | 93-02107 Y | 4/1993 |
| KR | 94-02736 Y | 4/1994 |

* cited by examiner

*Primary Examiner*—David Purol
(74) *Attorney, Agent, or Firm*—St. Onge Steward Johnston & Reens LLC

(57) ABSTRACT

Disclosed is an assembled electromotive curtain for easy installation, simple manipulation, and convenient maintenance. The assembled electromotive curtain allows an opening and closing of the curtain along a rail, and includes a main controller provided with a motor and a control circuit, and a wire driving part received within and fixed by the rail, for transferring a curtain transferring wire using a rotational force of a rotational shaft of a motor.

15 Claims, 10 Drawing Sheets

ASSEMBLY POWER CURTAIN

CROSS-REFERENCES TO RELATED APPLICATIONS

This application is a continuation of pending International Patent Application No. PCT/KR01/02288 filed Dec. 28, 2001, which designates the United States and claims priority of pending Korean Application Nos. 2000/84771, filed Dec. 28, 2000 and 2001/85145 filed Dec. 26, 2001. Both PCT Application No. PCT/KR01/02288 and Korean Application Nos. 2000/84771 and 2001/85145 are incorporated herein by reference.

BACKGROUND OF THE INVENTION

1. Field of the Invention

The present invention relates to an assembled electromotive curtain, and more particularly, to an assembled electromotive curtain for easy installation, simple manipulation and convenient maintenance.

2. Description of the Related Art

In the electromotive curtains, the curtain is opened or drawn by a driving force of a motor. Since the curtain has various sizes according to a size of a door or a window where the curtain is installed, it is difficult to standardize its size. Further, since the curtain is generally fabricated to order and thus a fabrication cost of the curtain is high, the electromotive curtain cannot be universalized in spite of its convenience.

Therefore, there has been proposed various kinds of assembled curtains. However, since it is difficult to install and maintain the curtain due to complexity in the structure thereof, the curtain is not yet universalized.

SUMMARY OF THE INVENTION

Therefore, it is an object of the present invention to provide an electromotive curtain which is capable of being installed in various sizes and maintained easily and conveniently.

Further, it is another object of the present invention to provide a DIY (do it yourself) type assembled electromotive curtain which is standardized for use at home at a low price.

To achieve the aforementioned object of the present invention, there is provided an assembled electromotive curtain in which a curtain is drawn or opened along a rail. The electromotive curtain comprises: a main controller in which a motor and a control circuit are built; and a wire driving part fixedly received within the rail, for transferring a curtain transferring wire using a rotational force of a rotational shaft of a motor, the main controller being detachably coupled to the wire driving part.

Further, the rail is comprised of a main rail and at least one auxiliary rail coupled to the main rail.

The wire driving part includes a rotational body rotated by the wire. The main controller includes sensing means for sensing rotation of the rotational body, and senses a moving state of the wire using the sensing means.

To achieve another object of the present invention, there is provided an assembled electromotive curtain in which a curtain is drawn or opened along a rail. The electromotive curtain comprises: a wire driving part fixedly received at one end of the rail; a tension maintaining part fixedly received at the other end of the rail; a loop-shaped curtain transferring wire wound around the wire driving part and the tension maintaining part by which tension is applied and having two straight lines at a horizontal transferring region of the curtain; and a wire fixing part fixed to each line of the wire and in which one end of the curtain is fixed so that the curtain is drawn or opened according to movement of the wire.

Preferably, the curtain further comprises a main controller detachably coupled to the wire driving part so as to provide rotational force to the wire driving part.

The wire driving part includes a rotational body rotated by the wire, and the main controller includes sensing means for sensing rotation of the rotational body and senses a stopping state of the rotational body using the sensing means when the rotational body is stopped, so that the main controller performs a control operation.

The wire driving part comprises a driving gear pulley rotated by a rotational body (e.g., a rotational shaft of a motor) inserted into a center portion thereof so as to drive the wire, an auxiliary pulley for providing tension to the wire wound around the driving gear pulley, a monitoring pulley rotated by the wire, and a guide roller for maintaining a gap between the two lines of the wire.

The main controller comprises a motor with rotational shaft inserted into a center portion of the driving gear pulley to be rotated by rotation of the motor, and with a monitoring rotational shaft inserted into a center portion of the monitoring pulley to be rotated, wherein the rotational shaft and the monitoring rotational shaft are protruded on a contact surface of a housing of the wire driving part.

The rail is comprised of a main rail and an auxiliary rail coupled to one end of the main rail, and the auxiliary rail has at least one or more cylindrical guide rods and a clip comprised of two plate type members, and the main rail is formed with a slot in which the guide rod is inserted, and the clip is fixed to a plate of the main rail by screws.

DETAILED DESCRIPTION OF THE DRAWINGS

Now, preferred embodiments of the present invention will be described in detail with reference to the annexed drawings. First, in adding reference symbols to respective elements shown on the drawings, it is noted that identical elements are represented by an identical symbol if possible although they are shown in different drawings. Also, although many specific items such as concrete elements and so on are shown in the following description, they are provided only for the purpose of general understanding of the present invention. Accordingly, It is evident to those having skills in the art that the present invention can be carried out without these specific items. Further, in describing the present invention, if it is determined that concrete description of a related prior art may make the subject matter of the present invention vague, detailed description thereof is omitted.

Figure 1:
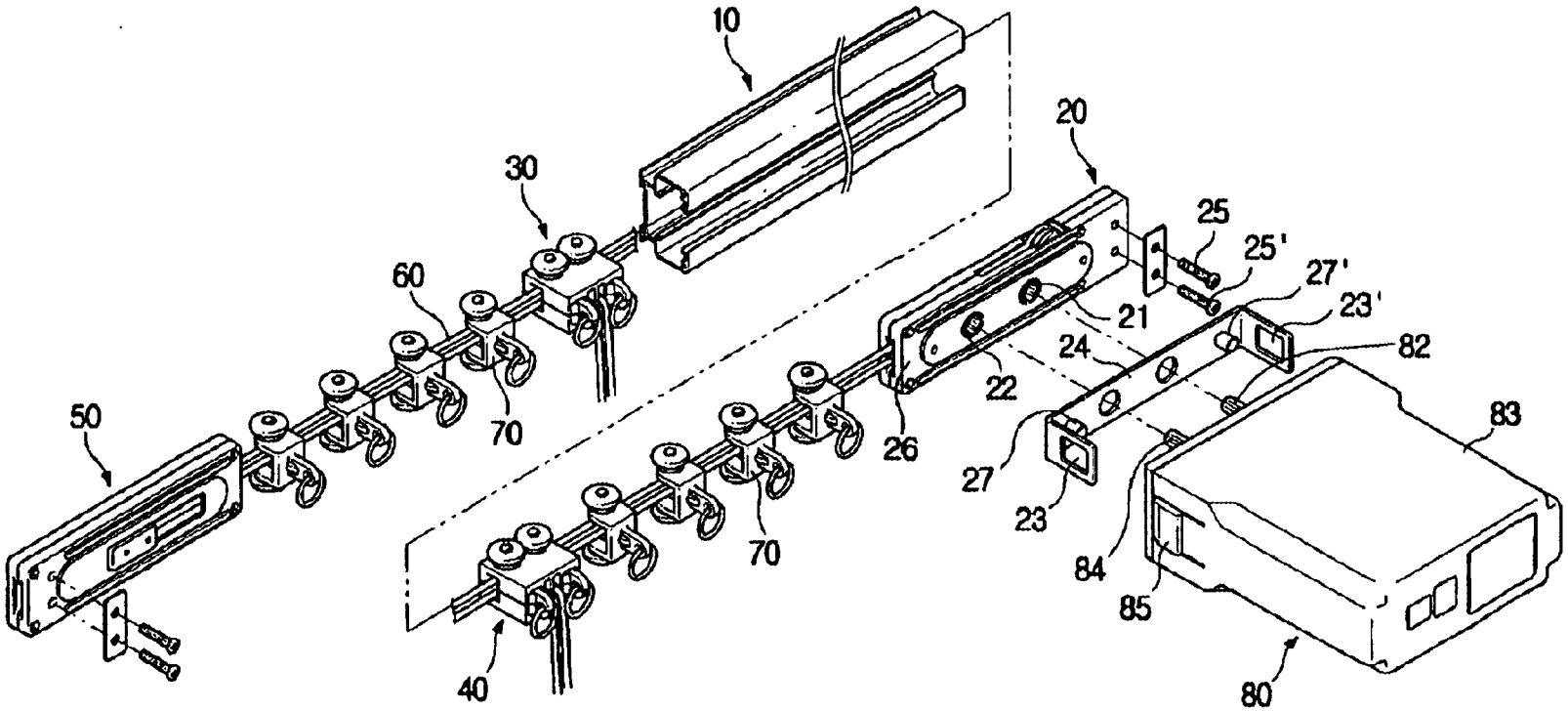
FIG. 1 is an exploded perspective view showing constructing components of a main rail according to one embodiment of the present invention.
Figure 2:
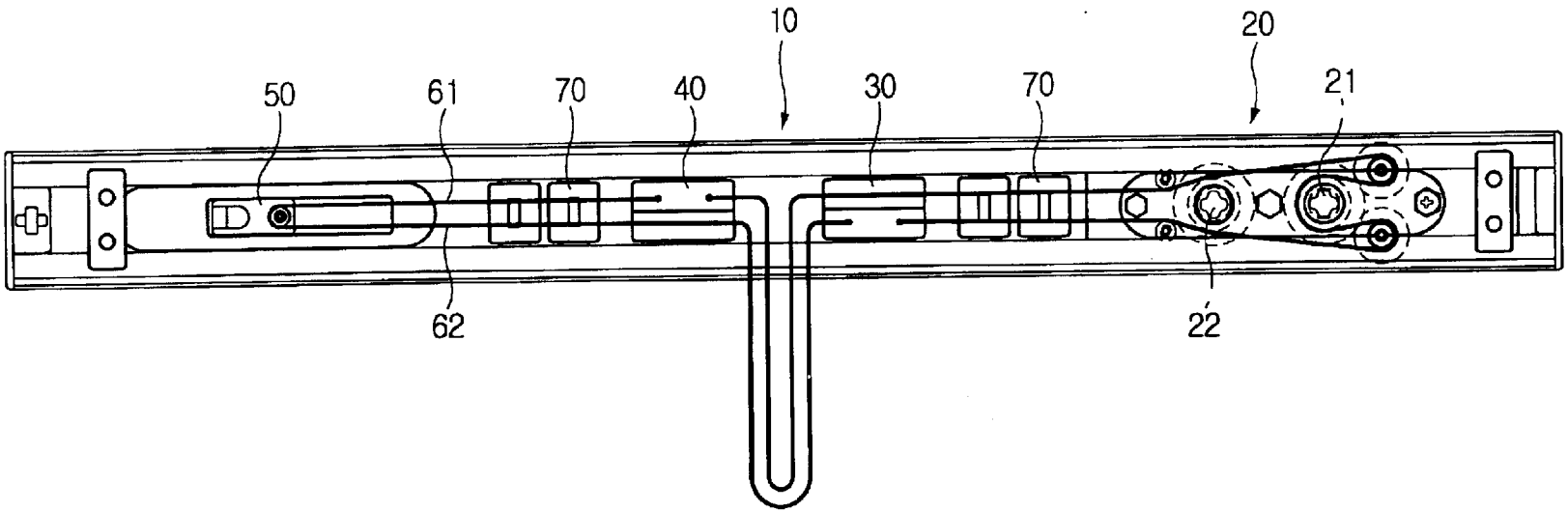
FIG. 2 is a cross-sectional view of the main rail of FIG. 2.

FIG. 1 is an exploded perspective view of components to be installed at a main rail according to an embodiment of the present invention, and FIG. 2 is a cross-sectional view of the main rail in which the components are installed.

A rail includes a main rail 10 and an auxiliary rail capable of being connected to the main rail. At one end of the main rail 10 is fixedly received a wire driving part 20. At the other end thereof is fixedly received a tension maintaining part 50. Further, there is provided a loop type wire 60, preferably, a rope forming a straight portion comprised of two lines to be enclosed by the wire driving part 20 and the tension maintaining part 50. The straight portion of the wire 60 forms a curtain transferring region. At the straight portion of the wire 60, there are provided wire fixing parts 30 and 40 fixed to the wire 60 to be capable of being respectively moved in an opposite direction. The wire fixing parts 30 and 40 are designed to be positioned at a center portion of the main rail 10 when the curtain is drawn, and to be moved to both ends of the main rail 10 according to movement of the wire 60 when the curtain is opened. A plurality of curtain carriers 70 are movably received in the main rail 10 between the tension maintaining part 50 and the wire fixing part 30, and between the wire fixing part 40 and the wire driving part 20. The curtain is fixed to a link portion of each curtain carrier. In addition, a main controller 80 is detachably mounted at the wire driving part 20 so as to provide rotational force to the wire driving part 20, thereby transferring the wire 60.

The main rail 10 has such a structure that all of the movable elements received in the main rail 10 can be stably moved.

Figure 3:
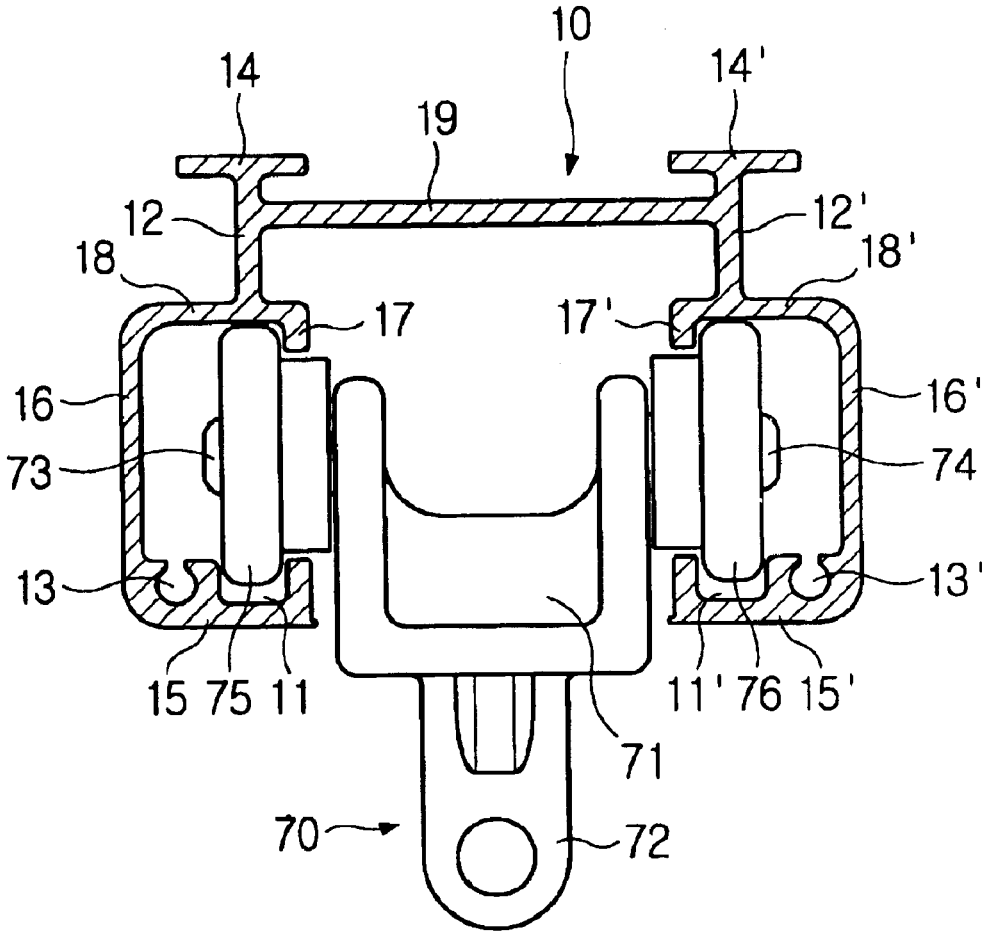
FIG. 3 is a cross-sectional view showing a status that a curtain carrier is received in the main rail according to one embodiment of the present invention.

FIG. 3 is a cross-sectional view showing a status that the curtain carriers are received in the main rail.

The curtain carrier 70 is comprised of a main body 71, a link portion 72 protruded from a lower surface of the main body to fix the curtain, rotational shafts 73 and 74 provided at both sides of the main body 71, and rollers 75 and 76 rotatably inserted onto the rotational shafts 73 and 74 to be moved along the main rail 10.

The main rail 10 is comprised of lower surfaces 15 and 15' formed by being cut away in a length direction so that the main body 71 of the curtain carrier 70 is movably disposed therebetween, sidewalls 16 and 16' extended upward from each of the lower surfaces 15 and 15', upper surfaces 18 and 18' horizontally extended from each of the sidewalls 16 and 16' to be opposite to the lower surfaces 15 and 15' and of which one end forms jaw portions 17 and 17' for preventing separation of the rollers 75 and 76, connection sidewalls 12 and 12' respectively extended upward from each upper surfaces 18 and 18', a fixing plate 19 formed between the connection sidewalls 12 and 12' to connect the upper surfaces 18 and 18' and to be fixed to an installation wall by screws, and supporting plates 14 and 14' formed at free ends of the connection sidewalls 12 and 12' to support the installation wall and to form a slot together with the fixing plate 19. The free ends of the connection sidewalls 12 and 12' are extended higher than the fixing plate 19 so that the fixing plate 19 is apart from the installation wall. A plate type member can be inserted into the slot between the fixing plate 19 and the supporting plates 14 and 14'.

In addition, the lower surfaces 15 and 15' of the main rail 10 are formed with grooves 11 and 11' in which the rollers 75 and 76 are rotatably mounted to be capable of being moved in the length direction. At a bent portion for connecting the sidewalls 16 and 16' and the lower surface 15 and 15', there are formed connection holes 13 and 13' extended in the length direction. The connection holes 13 and 13' have a slot shape for inserting a guide member. Thus, connection rods of an auxiliary rail, as described below, are inserted into the connection holes 13 and 13', so that the auxiliary rail can be facilely coupled to the main rail 10.

Other movable elements received in the main rail 10 have the same roller structure as the curtain carrier 70 like the curtain carrier 70 is movable within the main rail 10. Therefore, a description of the roller portions of other movable components will be omitted.

Figure 4:
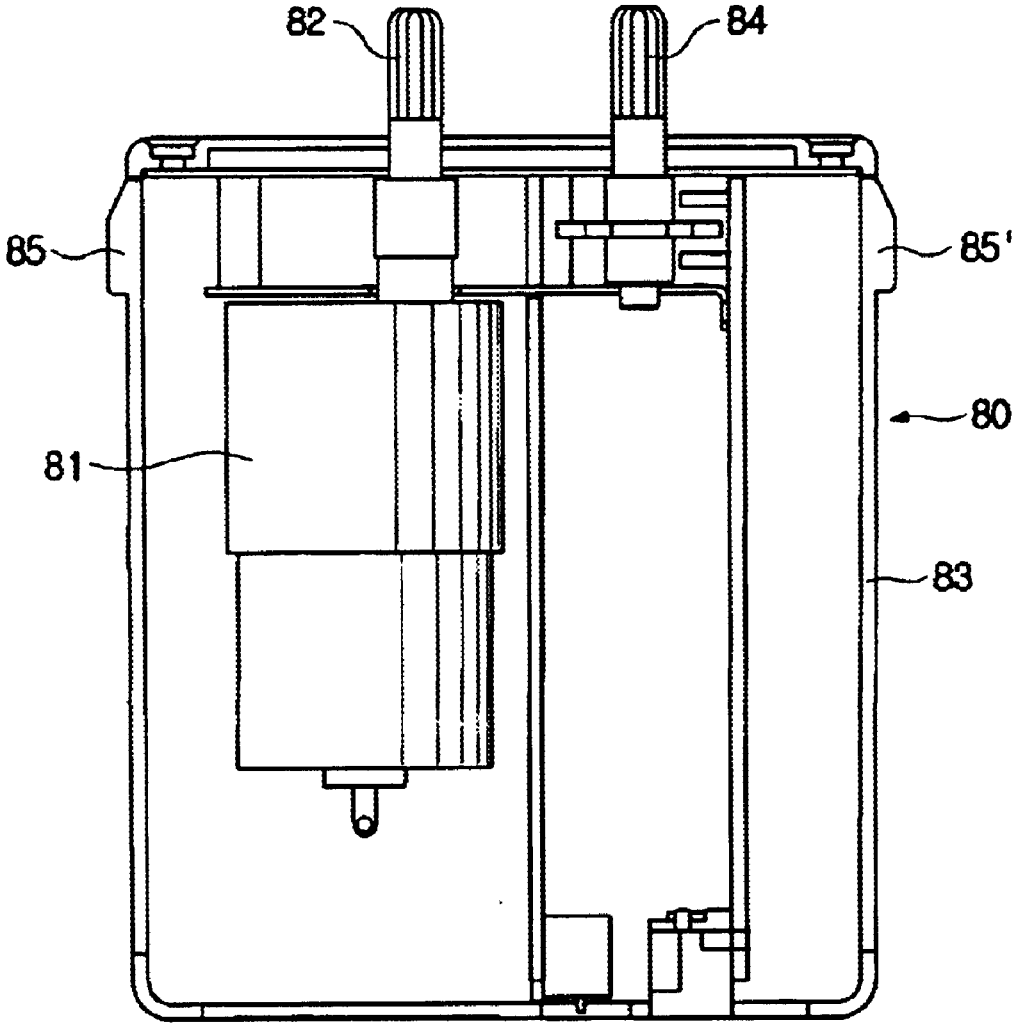
FIG. 4 is a cross-sectional view of a main controller according to one embodiment of the present invention.
Figure 5:
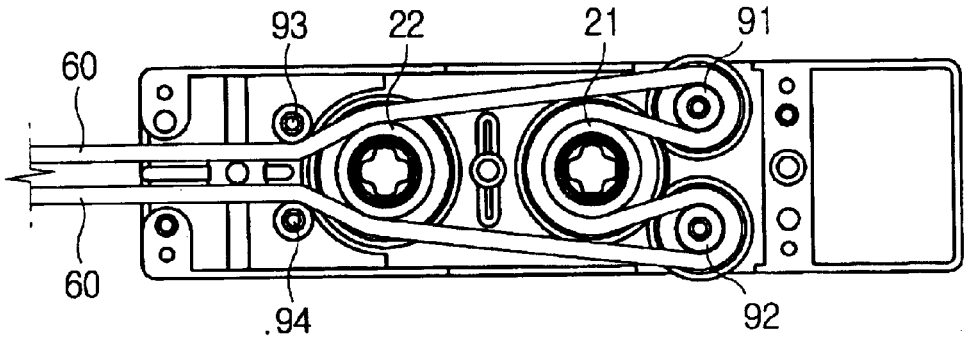
FIG. 5 is a cross-sectional view of a wire driving part according to one embodiment of the present invention.

FIG. 4 is a cross-sectional view of a main controller according to an embodiment of the present invention, and FIG. 5 is a cross-sectional view of a wire driving part according to an embodiment of the present invention.

A main controller 80 has a rotational shaft 82 protruded through a housing 83 to allow the rotational shaft 82 rotated by a motor 81 to transfer the curtain. Further, a monitoring rotational shaft 84 is provided to the housing 83 parallel with the rotational shaft 82. The rotational shaft 82 and the monitoring rotational shaft 84 are respectively inserted into a driving gear pulley 21 and a monitoring gear pulley 22 of a wire driving part 20 to mutually transmit and receive rotational force as will be described herein below. The monitoring rotational shaft 84 and the rotational shaft 82 have a rod shape with groove portions and protrusion portions alternately formed in a circumferential direction. Each of the driving gear pulley 21 and the monitoring gear pulley 22 has a blind hole at center portions thereof. At an inside wall of the blind hole, there are formed groove portions and protrusion portions corresponding to the groove portions and the protrusion portions of the monitoring rotational shaft 84 and the rotational shaft 82. Therefore, driving gear pulley 21 and the monitoring gear pulley 22 can be rotated according to rotation of the rotational shaft 82.

In addition, the main controller 80 has elastic members 85 and 85' at both sidewalls of the housing 83 thereof. Therefore, if the main controller 80 is forcily inserted into a coupling member 24 of the wire driving part 20, the elastic members 85 and 85' are pressed by latching jaws 23 and 23' formed at sidewalls of the coupling member 24. Then, when the main controller 80 is completely inserted into the coupling member 24, the elastic members 85 and 85' are fixedly latched to space portions of the latching jaws 23 and 23'. In case the main controller 80 has to be detached from the coupling member 24, a user pushes the elastic members 85 and 85' so that the elastic members 85 and 85' are separated from the latching jaws 23 and 23'.

The wire driving part 20 includes a housing 26 fixed to the main rail 10 by screws 25 and 25', and the coupling member 24 fixedly coupled to a lower surface of the housing 26. The coupling member 24 is formed with a lower surface, and the latching jaws 23 and 23' having the space portions formed at both sidewalls, in which the elastic members 85 and 85' are latched. Further, cylindrical poles 27 and 27' are formed downward at the lower surface of the coupling member 24. The cylindrical poles 27 and 27' function to guide a contact surface of the main controller 80 when the main controller 80 is coupled to the lower surface of the coupling member 24.

The driving pulley 21 and the monitoring pulley 22 are rotatably disposed in the housing 26 of the wire driving part 20. Auxiliary pulleys 91 and 92 are symmetrically disposed at a rear portion of the driving pulley 21 to tightly tense the wire. When the driving gear pulley 21 is rotated by the rotational shaft 82, the wire 60 wound around the driving gear pulley 21 and the auxiliary pulleys 91 and 92 is moved. Furthermore, guide rollers 93 and 94 are disposed at a front portion of the monitoring pulley 22 to constantly maintain a gap between the two lines of the wire 60 and also to widen an angle of the wire 60 to be contacted with the monitoring pulley 22, thereby increasing a contact surface area between the wire 60 and the monitoring pulley 22. Thus, frictional force between the wire 60 and the monitoring pulley 22 is also increased, and the monitoring pulley 22 can be rotated. The wire 60 is moved to an inner side portion of the left guide roller 93, and contacted with a left contact surface of the monitoring pulley 22, and wound around the rear portion of the left auxiliary pulley 91, the front portion of the driving gear pulley 21 and the rear portion of the right auxiliary pulley 92 in turn, and then passes an inner side portion of the right guide roller 94 while contacting with a right contact surface of the monitoring pulley 22.

Figure 6:
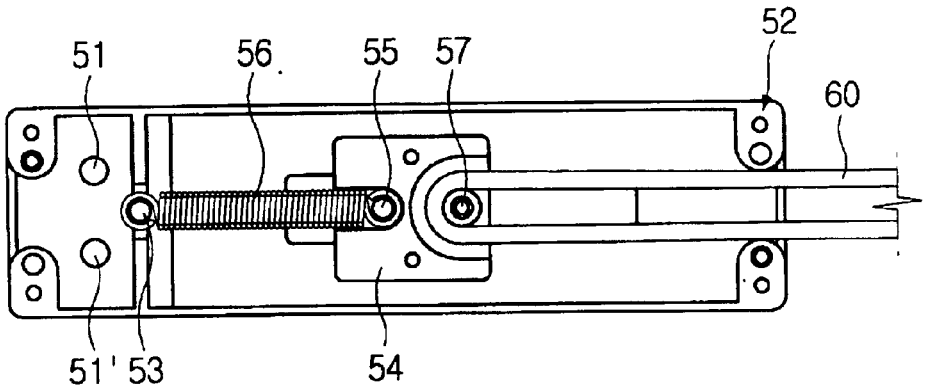
FIG. 6 is a cross-sectional view of a tension maintaining part according to one embodiment of the present invention.

FIG. 6 is a cross-sectional view of the tension maintaining part according to an embodiment of the present invention.

The tension maintaining part 50 is comprised of a housing 52 fixed to the main rail 10 by screws 51 and 51', a reciprocating member 54 disposed in the housing 52 to be movable along a slot formed in a length direction and to have a pulley 57 at a front end thereof and a fixing pin 55 at a rear end thereof, and a spring 56 of which one end is fixed to a fixing pin 53 of the housing 52 and the other is fixed to the fixing pin 55 of the reciprocating member 54. If the wire 60 wound on the pulley 57 is tightened, the tension is applied to the wire 60 by the elastic force of the spring 56. Therefore, the tension maintaining part 50 always keeps the wire 60 in a tight state.

Figure 7:
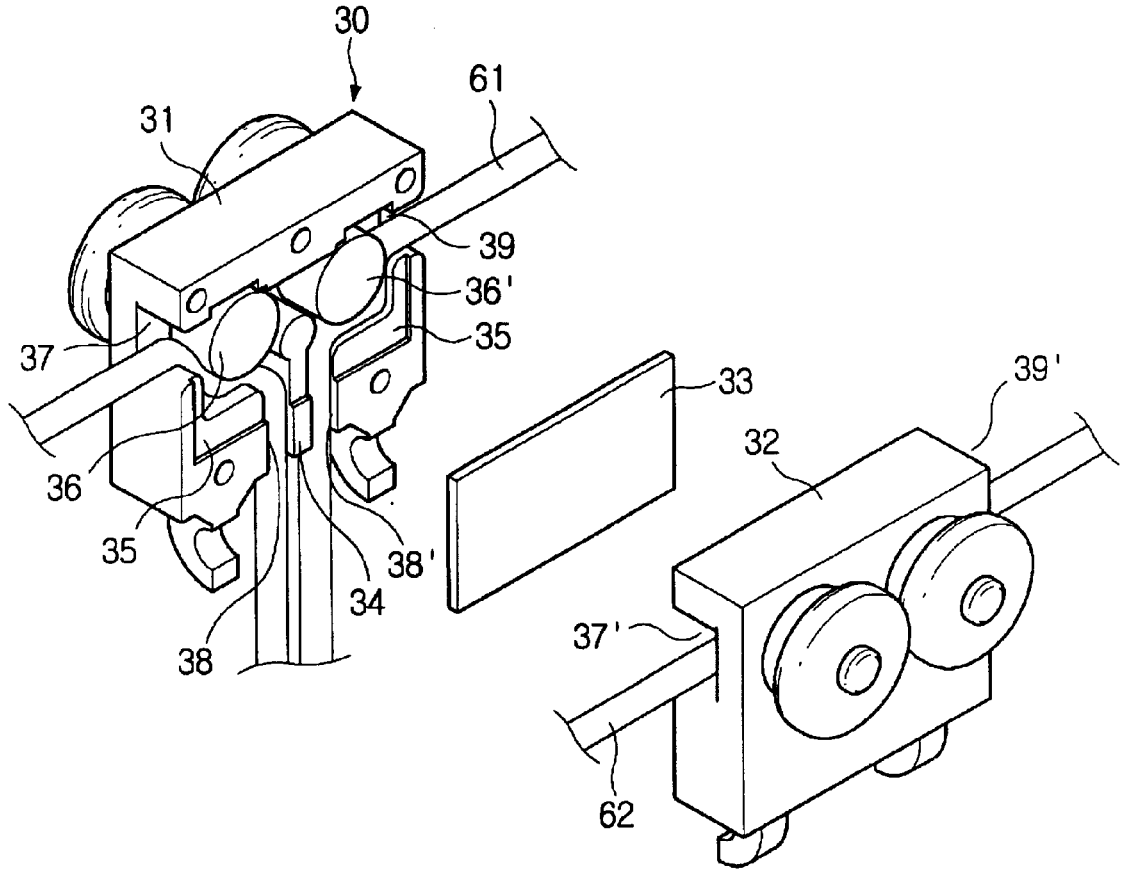
FIG. 7 is an exploded perspective view of a wire fixing part according to one embodiment of the present invention.

FIG. 7 is an exploded perspective view of the wire fixing part according to an embodiment of the present invention.

In FIG. 7, a left wire 61 of the wire 60 is fixed to the wire fixing part 30. The wire fixing part 30 includes a left housing 31 and a right housing 32 having a symmetrical structure and coupled to each other interposing a separating plate 33 therebetween. In the housings 31 and 32, there are formed a center partition wall 34, lower partition walls 35 and 35', and reverse rotation preventing members 36 and 36'. Further, at both sidewalls of the housings 31 and 32, there are formed through holes 37 and 37' through which the lines of the wire 60 are passed. The reverse rotation preventing members 36 and 36' are disposed in only one of the housings 31 and 32. In addition, at a lower center portion of the housings, i.e., both sides of the center partition wall 34, there are formed wire withdrawing holes 38 and 38'. The reverse rotation preventing members 36 and 36' are disposed in the left housing 31 of the wire fixing part 30. One end of the left wire 61 is introduced through the through hole 37 so as to pass a lower portion of the reverse rotation preventing member 36, and guided to an inner portion of the center partition wall 34, and then withdrawn through the wire withdrawing hole 38. In the same way, the other end of the left wire 61 is introduced through a through hole 39 to pass a lower portion of the reverse rotation preventing member 36', and then withdrawn through the wire withdrawing hole 38'. At this time, since the reverse rotation preventing members 36 and 36' are not disposed in the right housing 32, the right wire 62 just passes through the through holes 37' and 39'. Further, the reverse rotation preventing members 36 and 36' allow the wire 60 to move toward the wire withdrawing holes 38 and 38', but prevents movement of the wire 60 in a reverse direction, so that a length of the wire 60 is controlled by pulling the line 61 withdrawn through the wire withdrawing holes 38 and 38'. In another wire fixing part 40, two housings are also coupled to each other interposing a separating plate therebetween. However, the reverse rotation preventing members are provided in the right housing of the wire fixing part 40, and the two lines of the right wire 62 are withdrawn through wire withdrawing holes to an outside. The left wire 61 just passes through the left housing of the wire fixing part 40. As the result, only the right wire 62 is supported by the reverse rotation preventing members in the wire fixing part 40, and only the left wire 61 is supported by the reverse rotation preventing members in the wire fixing part 30.

Figure 8:
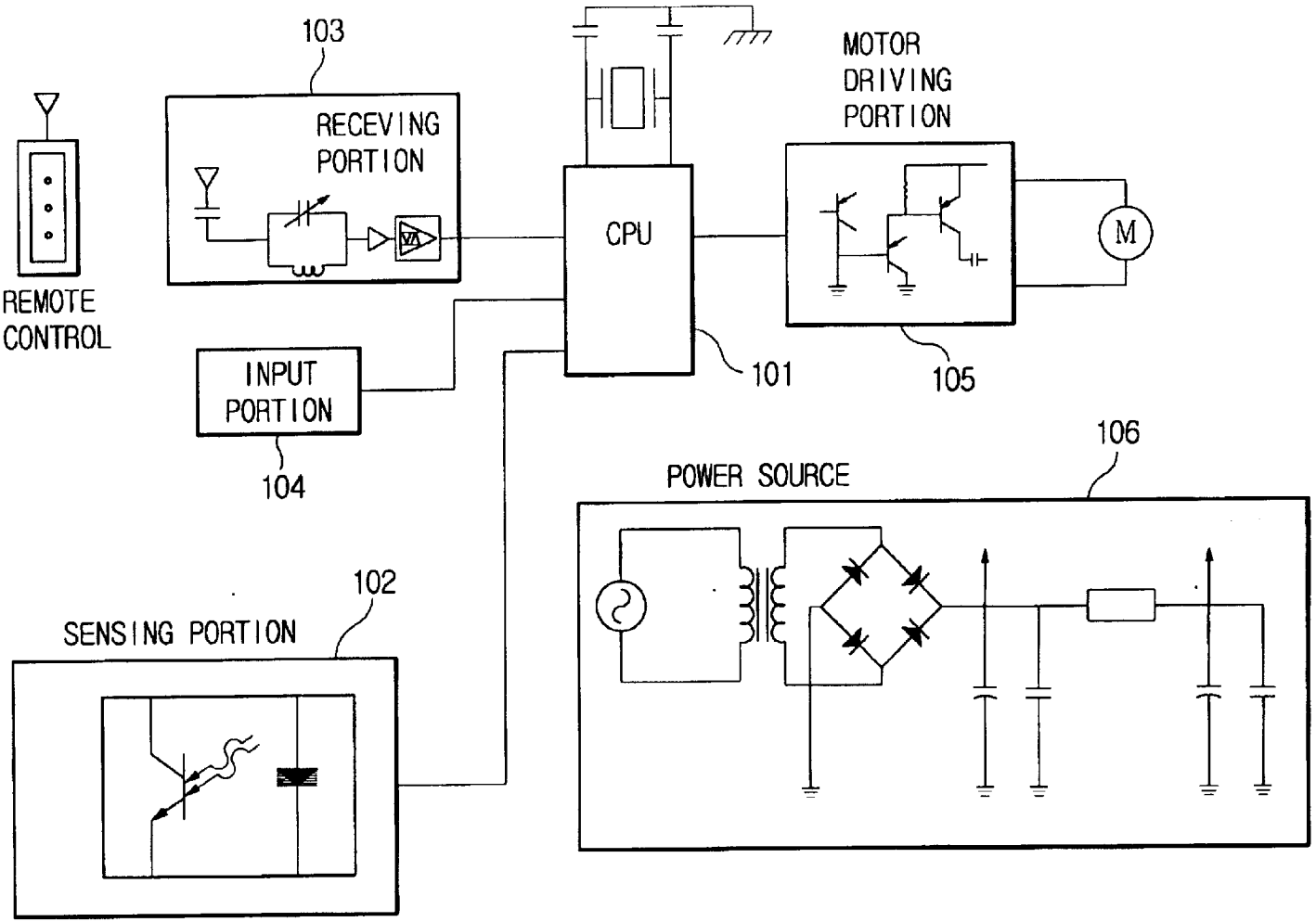
FIG. 8 is a circuit diagram of a main controller according to one embodiment of the present invention.

FIG. 8 is a circuit diagram of the main controller according to an embodiment of the present invention.

The main controller 80 includes a central processing unit 101 for controlling construction components according to an external input signal, a sensing portion 102 for sensing the movement of the wire 60 by rotation of the monitoring rotational shaft 84, a receiving portion 103 for receiving a signal transmitted from a remote controller, an input portion 104 for inputting a control command, a motor driving portion 105 for varying a speed of a motor or changing a rotational direction of the motor according to the control signal of the central processing unit 101, a motor M driven by the motor driving portion 105, and a power source 106 for supplying power.

Figure 9:
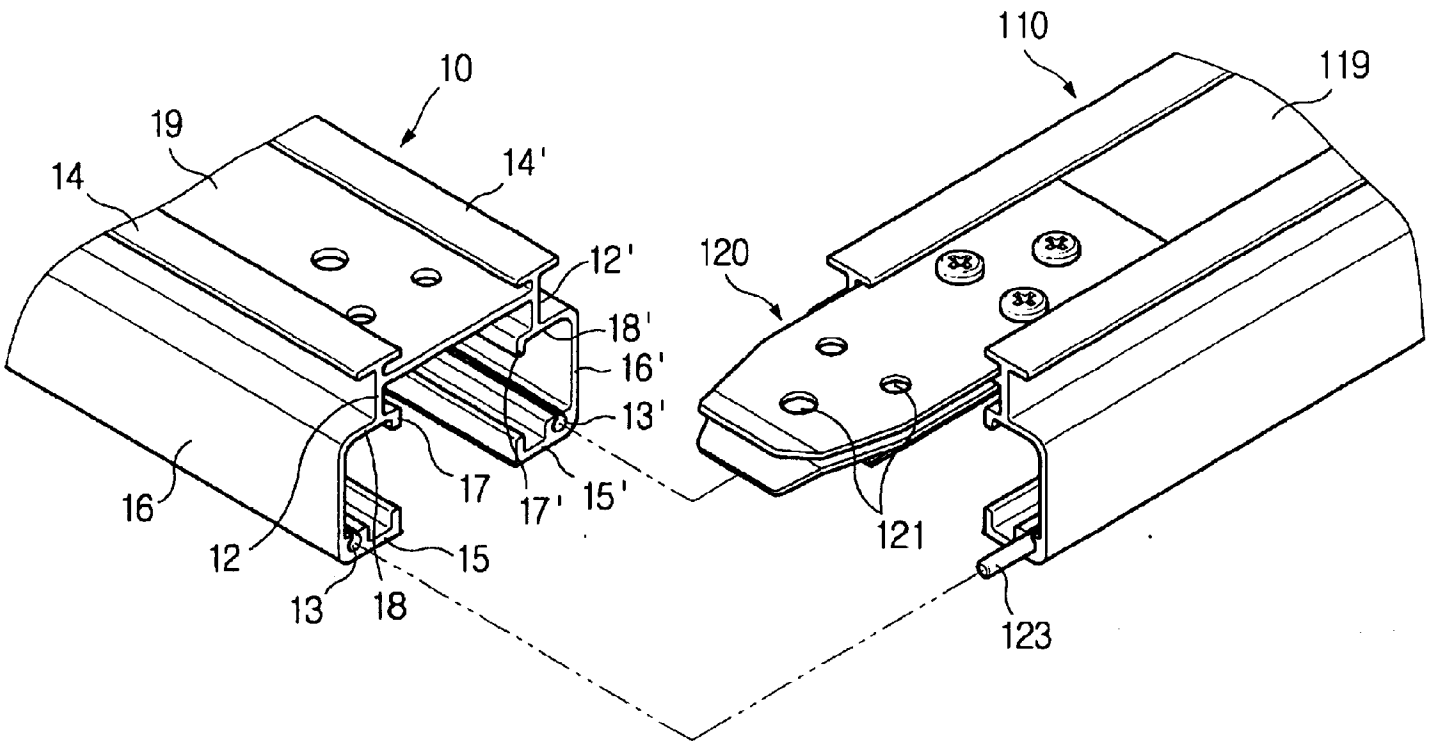
FIG. 9 is a perspective view showing a coupled structure of the main rail and an auxiliary rail according to one embodiment of the present invention.
Figure 10:
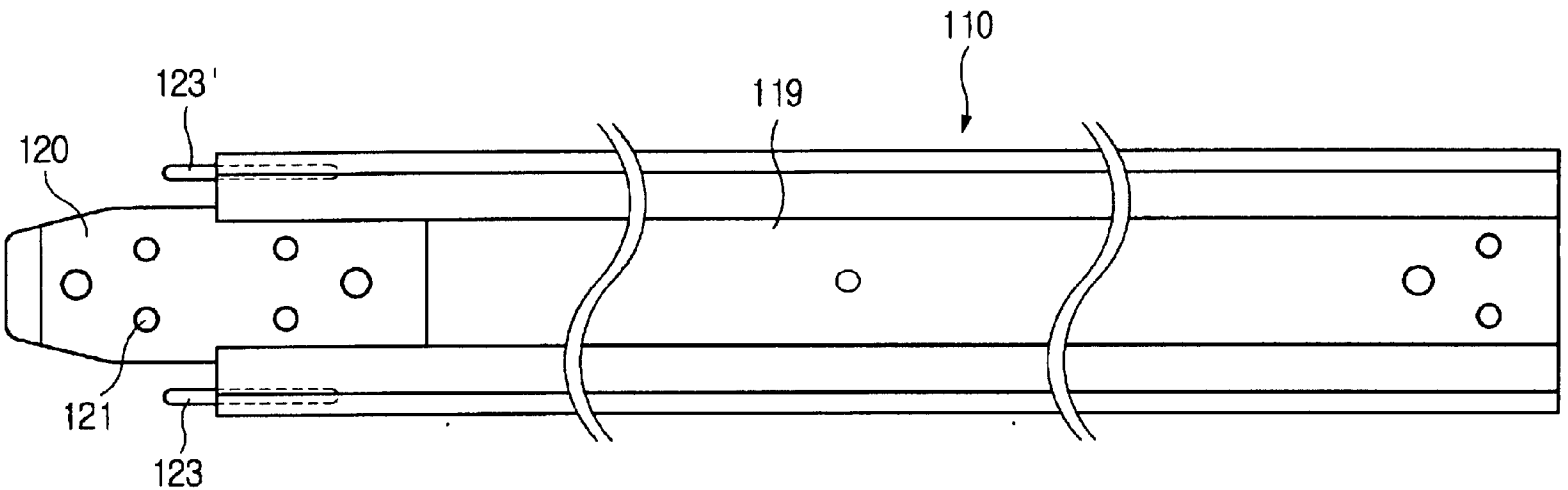
FIG. 10 is a plan view of the auxiliary rail according to one embodiment of the present invention.

FIG. 9 is a perspective view showing a coupling structure of the main rail and the auxiliary rail according to an embodiment of the present invention, and FIG. 10 is a plan view of the auxiliary rail according to the embodiment of the present invention.

One end of the auxiliary rail is fixedly inserted into the main rail 10, and the other end is coupled to other auxiliary rail so as to extent its own length.

On a fixing plate 119 of the auxiliary rail 110 contacted with the main rail 10, there is provided a clip 120 which is protruded toward the main rail 10 so as to be coupled to the fixing plate 19 of the main rail 10. At this time, the clip 120 is comprised of two plate type members apart from each other at an interval corresponding to a thickness of the fixing plate 19. After the clip 120 is coupled to the fixing plate 19, the clip 120 is fixed to the fixing plate 19 by screwing through screw holes 121 and 122 formed on the plate type members corresponding screw holes of the fixing plate. Further, at lower surfaces of the auxiliary rail 110, guide rods 123 and 123' are provided to insert into the connection holes 13 and 13' of the main rail 10. Therefore, the guide rods 123 and 123' are inserted into the connection holes 13 and 13' while the clip 120 is coupled to the fixing plate 19. In FIG. 10, one end of an auxiliary rail 110 has the same shape as the end of the main rail 10 so that other auxiliary rail can be fixedly coupled.

Hereinafter, an installation process and operation of the electromotive curtain of the present invention will be described in detail.

The auxiliary rails 110 are coupled to the main rail 10 to have a desired length corresponding to a length of a curtain to be installed.

First, the wire driving part 20 screwed on the main rail 10 is separated from the main rail 10 by loosing the screws, and positioned at a distal end of the last auxiliary rail, and then fixed again to the distal end of the auxiliary rail 100 by the screws. The main controller 80 is inserted into the latching jaws 23 and 23' so that the elastic members 85 and 85' of the main controller 80 are latched to the latching jaws 23 and 23'. At this time, the monitoring rotational shaft 84 and the rotational shaft 82 are respectively inserted into the driving gear pulley 21 and the monitoring pulley 22 of the wire driving part 20 so as to transmit the rotational force to each other. The cylindrical poles 27 and 27' of the wire driving part 20 are inserted into guide holes (not shown) of the main controller 80 so as to guide the main controller 80 when the main controller 80 is coupled to or separated from the wire driving part 20. The curtain is latched to the plurality of curtain carriers 70. One end of the curtain is fixed to a carrier of the wire fixing part 30, and the other end is fixed to a carrier of the fixing wire portion 40 If the two lines of the wire, withdrawn through the wire withdrawing holes of the wire fixing part 30 and 40, are pulled, the tension is generated at the wire, so that the curtain is tightly installed. Then, the curtain is drawn or opened by the operation of the motor.

Figure 11:
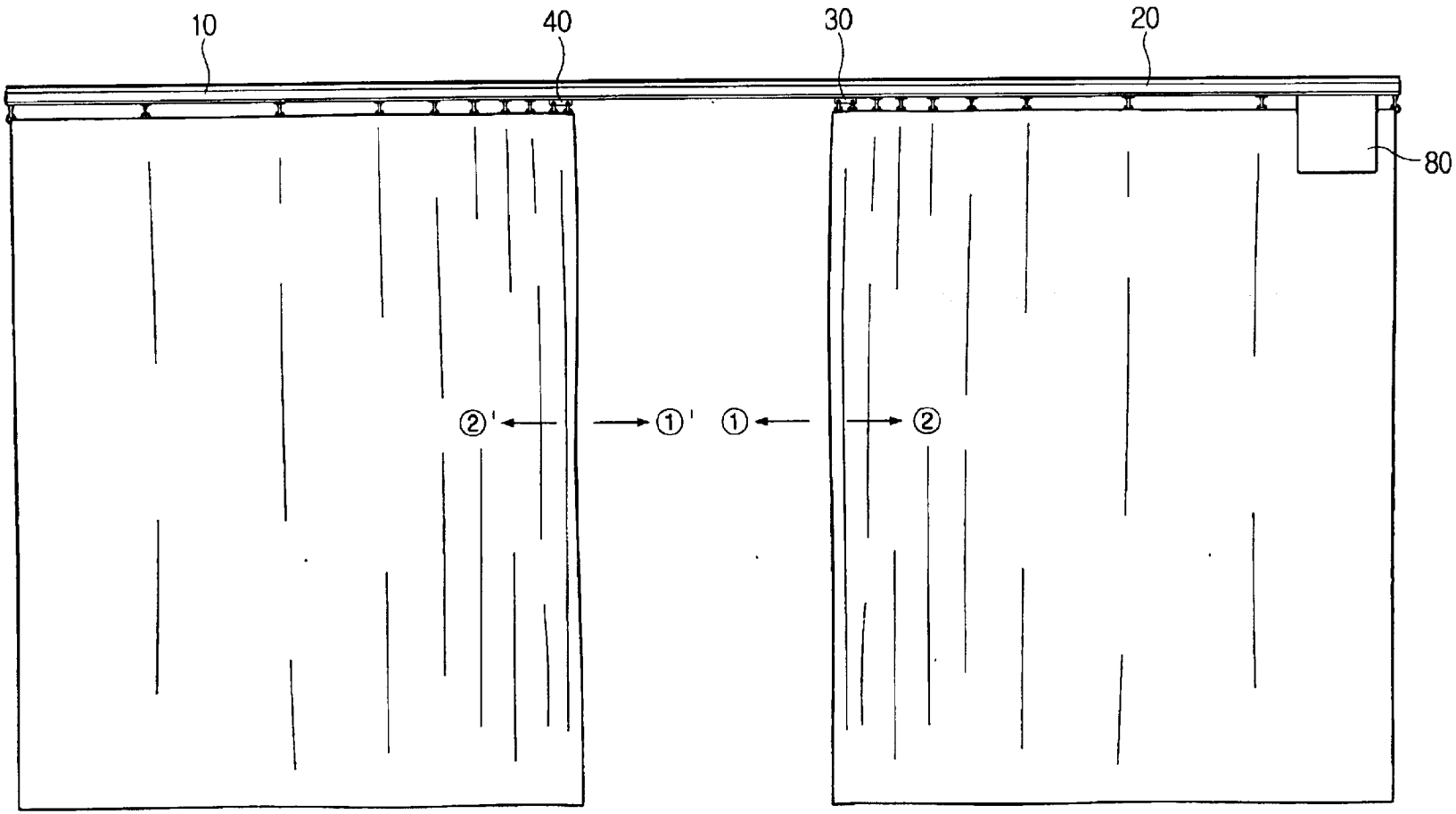
FIG. 11 is a front view showing an operation of a curtain according to one embodiment of the present invention.

FIG. 11 is a front view showing an operation of the curtain according to an embodiment of the present invention.

The operation of the curtain shown in FIG. 11 will be described on the basis of a wire arranging state. The left wire fixing part 30 is fixed to the left wire 61, and the right wire fixing part 40 is fixed to the right wire 62. If the driving gear pulley 21 is rotated by the rotational shaft 82, the left wire fixing part 30 fixed to the left wire is moved to a direction of ①, and the right wire fixing part 40 fixed to the right wire 62 is moved to a direction of ①' until both sides of the curtain are met at a center portion and the curtain cannot move any more. In a drawn state of the curtain, the monitoring pulley 22 cannot rotate no longer. This state is detected by the sensing portion 102. Thus, the motor is stopped by the central processing unit 101. If an opening signal is input to the central processing unit 101 using the input portion 104 or the remote controller to open the curtain, the motor is rotated in the counter clockwise direction by the central processing unit 101, so that the driving gear pulley 21 is rotated in the counter clockwise direction. In this situation, the left wire fixing part 30 fixed to the left wire 61 is moved to a direction of ②, and the right wire fixing part 40 fixed to the right wire 62 is moved to a direction of ②'. Therefore, the curtain is opened. If the wire fixing parts 30 and 40 cannot moved no longer by the curtain carriers, the monitoring pulley is stopped. This state is also detected by the central processing unit 101. As the result, the motor is stopped and the opening operation is completed.

While the present invention has been described in detail, it should be understood that various changes, substitutions and alterations could be made hereto without departing from the spirit and scope of the invention as defined by the appended claims.

According to the electromotive curtain of the present invention:

(1) It is simple and easy to install the curtain at home.

(2) Since the main controller, which is frequently out of order, is detachably disposed at a constructing component of the rail instead of the rail body, it is easy to maintain and repair the electromotive curtain.

(3) It is possible to change a drawing or opening speed of the curtain by varying a voltage and thus changing a rotational speed of the motor.

(4) It is possible to facilely extend a length of the rail by simply coupling the auxiliary rail to the main rail.

(5) Further, since the main rail and the auxiliary rail can be standardized, a fabricating cost is lowered.

(6) Since a stopping state of the wire can be detected in a simple way, it is also possible to prevent overload of the motor, thereby extending a lift span of the motor.

What is claimed is:

1. An electromotive curtain assembly for positioning at least a curtain along a rail, comprising:

a rail for placing curtains thereto;

a curtain transferring wire coupled with the rail;

a controller including a motor, a control circuit, and a sensing means for detecting the position of the curtains; and a wire driving member coupled to the rail, the wire driving member adapted to transfer the curtain transferring wire and thereby the curtains using a rotational force of the motor, the controller being detachably coupled to the wire driving member and controlling positioning of the curtains using the position of the curtains detected by the sensing means.

2. The electromotive curtain assembly of claim 1, wherein the rail is comprised of a main rail and at least one auxiliary rail coupled to the main rail.

3. The electromotive curtain assembly of claim 1, or 2, wherein the wire driving member includes a rotational body rotating by the wire, and the sensing means of the main controller is adapted to detect rotation of the rotational body for the detection of the curtain position.

4. An electromotive curtain assembly for positioning at least a curtain along a rail, comprising;

a rail for placing curtains thereto;

a wire driving member coupled to one end of the rail;

a tension maintaining member coupled to the other end of the rail;

a loop-shaped curtain transferring wire wound around the wire driving member and the tension maintaining member by which tension is applied, the loop-shaped curtain transferring wire having two straight lines at a horizontal transferring region of the curtains;

a first and second wire fixing members, each of the wire fixing members fixed to a corresponding straight line of the wire and having one end of the curtains affixed thereto so that the curtains are drawn or opened according to movement of the wire; and a controller having a motor, and a sensing means for detecting the position of the curtains, the controller detachably coupled to the wire driving member so as to transfer the wire for positioning of the curtains using the position of the curtains detected by the sensing means.

5. The electromotive curtain assembly of claim 4, wherein the wire driving member includes a rotational body rotating by the wire, and the sensing means of the controller is adapted to detect rotation of the rotational body for the detection of the curtain position.

6. The electromotive curtain assembly of claim 4, wherein the wire driving member comprises a driving gear pulley rotatable by the motor to drive the wire, an auxiliary pulley for providing tension to the wire wound around the driving gear pulley, a monitoring pulley rotatable by the wire, and a guide roller for maintaining a gap between the two lines of the wire.

7. The electromotive curtain assembly of claim 1 or 4, wherein the rail is comprised of a main rail and an auxiliary rail coupled to one end of the main rail, and the auxiliary rail has at least one cylindrical guide rod and a clip comprised of two plate type members, and the main rail is formed with a slot into which the guide rod is inserted, and the clip is fixed to a plate of the main rail by screws.

8. The electromotive curtain assembly of claim 6, wherein the controller comprises a rotational shaft detachably coupled to the driving gear pulley for rotating by rotation of the motor, and a monitoring rotational shaft detachably coupled to the monitoring pulley to be rotated.

9. The electromotive curtain assembly of claim 8, wherein the rotational shaft and the monitoring rotational shaft of the controller are configured to slidably fit to corresponding receiving holes of the respective driving gear pulley and monitoring pulley.

10. The electromotive curtain assembly of claim 8, wherein the sensing means is adapted to detect rotation of the monitoring rotational shaft for the detection of the curtain position.

11. The electromotive curtain assembly of claim 4, wherein the controller has a housing for enclosing the motor and the sensing means therein.

12. The electromotive curtain assembly of claim 11, wherein the housing of the controller has a mounting element for detachable coupling to the wire driving member.

13. The electromotive curtain assembly of claim 12, wherein the mounting element of the housing comprises an elastic portion.

14. The electromotive curtain assembly of claim 13, wherein the wire driving member comprises a latching portion for coupling with the elastic portion of the housing.

15. The electromotive curtain assembly of claim 4, wherein each of the wire fixing members comprises a reverse rotation prevention member for preventing reverse rotation of the wire wound there-around.

* * * * *